US008408115B2

(12) United States Patent
Barger

(10) Patent No.: US 8,408,115 B2
(45) Date of Patent: Apr. 2, 2013

(54) SYSTEMS AND METHODS FOR AN INDICATOR FOR A WEAPON SIGHT

(75) Inventor: James Edwin Barger, Winchester, MA (US)

(73) Assignee: Raytheon BBN Technologies Corp., Cambridge, MA (US)

( * ) Notice: Subject to any disclaimer, the term of this patent is extended or adjusted under 35 U.S.C. 154(b) by 253 days.

(21) Appl. No.: 12/886,073

(22) Filed: Sep. 20, 2010

(65) Prior Publication Data

US 2012/0067201 A1 Mar. 22, 2012

(51) Int. Cl.
*F41G 1/00* (2006.01)

(52) U.S. Cl. ..... 89/41.19

(58) Field of Classification Search ..... 89/41.19, 89/41.21, 41.22, 203–206; 42/111, 141; 235/404, 405

See application file for complete search history.

(56) References Cited

U.S. PATENT DOCUMENTS

| | | | | | |
|---|---|---|---|---|---|
| 3,438,305 | A * | 4/1969 | Nollet | 89/41.22 |
| 4,326,340 | A * | 4/1982 | Blomqvist et al. | 89/204 |
| 4,386,848 | A | 6/1983 | Clendenin et al. | |
| 4,592,654 | A | 6/1986 | Girault et al. | |
| 5,171,933 | A * | 12/1992 | Eldering | 89/41.06 |
| 5,241,518 | A * | 8/1993 | McNelis et al. | 367/127 |
| 5,359,920 | A | 11/1994 | Muirhead et al. | |
| 5,379,676 | A * | 1/1995 | Profeta et al. | 89/41.05 |
| 5,431,084 | A | 7/1995 | Fowler et al. | |
| 5,483,865 | A | 1/1996 | Brunand | |
| 5,930,202 | A * | 7/1999 | Duckworth et al. | 367/127 |
| 5,970,024 | A * | 10/1999 | Smith | 367/128 |
| 6,237,462 | B1 * | 5/2001 | Hawkes et al. | 89/41.05 |
| 6,802,239 | B1 | 10/2004 | Sanderson | |
| 6,965,541 | B2 * | 11/2005 | Lapin et al. | 367/118 |
| 7,239,976 | B2 * | 7/2007 | Coleman et al. | 702/153 |
| 8,111,582 | B2 * | 2/2012 | Beck et al. | 367/118 |
| 2002/0167862 | A1 * | 11/2002 | Tomasi et al. | 367/118 |

* cited by examiner

*Primary Examiner* — Michael Carone
*Assistant Examiner* — Reginald Tillman, Jr.
(74) *Attorney, Agent, or Firm* — Lando & Anastasi, LLP

(57) ABSTRACT

The systems and methods described herein provide military personnel with a swift and accurate means to return fire at a detected shooter. In particular, the systems and methods described herein relate to an indicator for a weapon sight. In some embodiments, the indicator is electromechanical. In some embodiments, the indicator is configured to be moveable such that when the weapon sight is aligned with the indicator, the weapon points in the direction of the detected shooter. In some embodiments, the indicator is attached to the weapon itself, while in other embodiments, the indicator is attached to the weapon mount. The weapon may be located on a ground vehicle, aircraft, or may be portable. In some embodiments, the system includes a processor configured to receive a shooter's location, determine the position of the indicator based on the received shooter location, and control the indicator to move into the determined position. In some embodiments, the system may provide the location of more than one shooter to military personnel and the location of the second shooter may be provided in the form of an aural or visual signal.

30 Claims, 12 Drawing Sheets

SYSTEMS AND METHODS FOR AN INDICATOR FOR A WEAPON SIGHT

GOVERNMENT CONTRACT

The U.S. Government has a paid-up license in this disclosure and the right in limited circumstances to require the patent owner to license others on reasonable terms as provided for by the terms of Contract No. HR0011-07-C-0103 awarded by the Defense Advanced Research Projects Agency.

FIELD

The present disclosure relates generally to providing a shooter's location to a gunner on a military vehicle, and more particularly to a system and method for assisting a gunner in aiming a weapon towards a shooter using a controllable indicator.

BACKGROUND

With recent developments in weapons technology combined with an evolving face of global terrorism, there has been an increase in the threat posed to military forces in combat, rescue and humanitarian missions. In particular, shooters such as terrorist militiamen are using inexpensive, portable and readily available weapons such as sniper rifles, assault rifles and shoulder-fired missiles against ground vehicles such as High Mobility Multipurpose Wheeled Vehicles (humvees) or even aircraft, such as helicopters and airplanes. For aircrafts, there is particular danger when the aircraft is flying low during flight, landing and takeoff As used herein, a "shooter" refers to an enemy firing a weapon at military personnel, while a "gunner" refers to military personnel firing a weapon at a shooter.

Systems exist for determining the location of a shooter from a vehicle or an aircraft. Illustrative systems include sensors that record acoustic shockwave signals generated by an incoming projectile. Illustrative examples of ground vehicle mounted or stand-alone shooter detection systems are described in commonly-owned U.S. Pat. Nos. 7,710,828 and 7,126,877 and PCT Publication Number WO2006/096208, the contents of each of which are incorporated herein by reference in their entirety. Illustrative examples of airborne shooter detection systems are disclosed in commonly-owned U.S. patent application Ser. Nos. 12/220,745 and 12/629,761 and PCT Publication Number WO 2010/030433, the contents of each of which are incorporated herein in their entirety.

Each of the abovementioned systems and methods detect incoming projectiles, detect or determine the shooter's location, and provide aural and/or visual warnings to military personnel. For instance, such warnings may be an audio announcement of the form "Incoming shot at X o'clock and Y meters", where X and Y are determined by the shooter detection system, or may be a visual indication such as an illuminated pointer in a gunner's helmet display or a pilot's heads-up display. The military personnel, such as a gunner on an aircraft, need to manually move their weapon in response to these warnings. In some cases, particularly in situations in which the ground vehicle or aircraft is trying to penetrate enemy territory undetected, illuminated pointers can be seen by attacking militiamen, and may even inadvertently provide the ground vehicle's or aircraft's location to these attacking militiamen. In addition, because the gunners need to accurately move their weapons to point them at the detected shooter location, there may be inaccuracies in positioning the weapon and in turn, in the return fire from the gunner's weapon to the shooter.

Accordingly, there is a need for a system and method that assists gunners in aiming their weapons towards detected shooters in an accurate, quick, and non-disruptive manner.

SUMMARY

In one aspect, this invention relates to a system and method for providing military personnel with a swift and accurate means to return fire at a detected shooter. In particular, the systems and methods described herein relate to an indicator for a weapon sight. In some embodiments, the indicator is electromechanical. For example, the indicator may include a rod and a target coupled to a servo device. In some embodiments, the indicator is configured to be moveable such that when the weapon sight, which may be any suitable weapon sight, e.g., a front or a rear weapon sight, is aligned with the indicator, the weapon points in the direction of the detected shooter. In some embodiments, the indicator is attached to the weapon itself For example, the indicator may be attached atop the weapon's breach block if it is desired that the indicator be attached to the weapon when the weapon is dismounted from its mount and/or moved to another weapon mount. In other embodiments, the indicator is attached to the weapon mount if it is desired not to have the indicator on the weapon itself. The weapon may be located on a ground vehicle, aircraft, or may be portable. In some embodiments, the system includes a processor configured to receive a shooter's location, determine the position of the indicator based on the received shooter location, and control the indicator to move into the determined position.

In some embodiments, the system may provide the location of more than one shooter to military personnel. The location of the second shooter may be provided in the form of an aural or visual signal. The indicator may be configured to move position from being directed at the first shooter to being directed at the second shooter in response to a received input. The input may be received from military personnel such as a gunner on an aircraft.

In some embodiments, the indicator may include a rear sight ring attached to an indicator rod that is moved independently in both the horizontal and vertical directions by two independent servo motors. The first servo motor moves the rod horizontally and is rigidly fixed to the weapon (or to the weapon mount) with its shaft vertical. The second servo motor is rigidly attached to the weapon (or to the weapon mount) with its shaft horizontal. The indicator rod is attached to this horizontal shaft and is perpendicular to the shaft axis. The servo motors are actuated based on information received from the shooter detection system. In this manner, the servo motors ensure that the indicator rod is positioned such that when the weapon sight is aligned with the indicator target, the weapon is pointed at the detected shooter's location.

More particularly, in one aspect, the invention relates to a system for providing an indication of a shooter location. The shooter location is determined by a shooter detection system. The system includes a weapon having a weapon sight and a moveable electromechanical indicator. The indicator is configured to be moved to a position such that when the weapon sight is aligned with the electromechanical indicator, the weapon points substantially towards the shooter location. The system also includes an actuator for controlling the position of the indicator and a processor. The processor is configured to receive the shooter location from the shooter detection system and determine the position for the indicator based on the received shooter location. More generally, the processor may be configured to receive target information from the processor of any suitable system, e.g., a remote processor located in an aircraft or ground station. The processor is also configured to control the actuator to move the indicator to the determined position.

In some embodiments, the weapon is removeably attached to a weapon mount. In some embodiments, the weapon is mounted on one of an aircraft or a ground vehicle. In some embodiments, the processor is configured to receive a signal indicative of the weapon's position. In response to the received signal, the process is configured to determine an updated position for the indicator. In some embodiments, the processor is configured to receive an updated shooter location from the shooter detection system, and in response to the received signal, determine an updated position for the indicator. In some embodiments, the system also includes a user input device configured to receive a user input.

In some embodiments, the processor is configured to receive a second shooter location from the shooter detection system. The processor is configured to determine a second position for the indicator based on the received second shooter location, and to control the actuator to move the indicator to the determined second position. Optionally, the processor is configured to provide an aural signal indicative of the second shooter location. In alternative embodiments, the system includes a user input device configured to receive a user input, and the processor is configured to control the actuator to move the indicator to the determined second position in response to the received user input.

In some embodiments, the system includes a communications device in communication with the processor. The communications device is configured to receive a signal from a remote processor. The signal may be indicative of the location of one of an aircraft, a ground vehicle, a target location, and the shooter location.

In some embodiments, the system also includes a global positioning system (GPS) location system. The GPS location system communicates with the processor, and is configured to provide a signal indicative of one of the absolute position of the weapon, the location of the weapon relative to the shooter location, and the location of the weapon relative to one of an aircraft and ground vehicle.

In some embodiments, the electromechanical indicator of the system includes a servo device. The servo device includes a first servo motor for horizontal actuation of the indicator, a second servo motor for vertical actuation of the indicator, and a base for mounting at least one of the first and the second servo motors. The processor is then configured to receive one or more motor position signals from the servo device, and to determine a servo device control signal based at least in part on the received shooter location and the received motor position signals. The processor is also configured to communicate the servo device control signal to the servo device, the control signal providing instructions for actuating the first and second motors to move the indicator to a position prescribed by the servo device control signal.

In some embodiments, the electromechanical indicator includes an indicator rod. In some embodiments, the indicator rod includes or is coupled to a self-restoring joint to prevent damage to the indicator or injury to the gunner during weapon movement. In some embodiments, the indicator rod and/or the indicator target is flexible.

In another aspect, the invention relates to a method for providing an indication of a shooter location determined by a shooter detection system. The method includes receiving the shooter location from the shooter detection system. The method further includes determining a position for a moveable electromechanical indicator based on the received shooter location, the position such that when a weapon sight for a weapon is aligned with the electromechanical indicator, the weapon points substantially towards the shooter location. The method also includes controlling an actuator coupled to the indicator to move the indicator to the determined position.

In some embodiments, the method further includes receiving a signal indicative of the weapon's position, and in response to the received signal, determining an updated position for the indicator. In some embodiments, the method further includes receiving an updated shooter location from the shooter detection system, and in response to the received signal, determining an updated position for the indicator.

In some embodiments, the method further includes receiving a second shooter location from the shooter detection system. The method also includes determining a second position for the indicator based on the received second shooter location, and controlling the actuator to move the indicator to the determined second position. Optionally, the method includes providing an aural signal indicative of the second shooter location. Optionally, the method includes receiving a user input from a user input device, and controlling the actuator to move the indicator to the determined second position in response to the received user input.

In some embodiments, the method includes receiving a signal from a remote processor. The signal may be indicative of the location of one of an aircraft, a ground vehicle, and the shooter location.

In some embodiments, the method includes receiving a signal from a global positioning system (GPS) location system. The signal may be indicative of one of the absolute position of the weapon, the location of the weapon relative to the shooter location, and the location of the weapon relative to one of an aircraft and ground vehicle.

In some embodiments, the method includes receiving one or more motor position signals from a servo device; the servo device including a first servo motor for horizontal actuation of the indicator and a second servo motor for vertical actuation of the indicator. The method also includes determining a servo device control signal based at least in part on the received shooter location and the received motor position signals. The method further includes communicating the servo device control signal to the servo device, the control signal providing instructions for actuating the first and second motors to move the indicator.

BRIEF DESCRIPTION OF THE DRAWINGS

The following figures depict certain illustrative embodiments of the invention in which like reference numerals refer to like elements. These depicted embodiments may not be drawn to scale and are to be understood as illustrative of the invention and as not limiting in any way.

DETAILED DESCRIPTION

To provide an overall understanding of the invention, certain illustrative embodiments will now be described, including apparatus and constituent components thereof. However, it will be understood by one of ordinary skill in the art that the apparatus described herein may be adapted and modified as is appropriate for the application being addressed and that the systems and methods described herein may be employed in other suitable applications, and that such other additions and modifications will not depart from the scope hereof.

In this disclosure, implementations will primarily be described with respect to aircraft shooter detection systems, ground vehicle shooter detection systems and stand-alone indicator systems for weapons. Those skilled in the art will realize that other applications also fall within the scope of the embodiments disclosed herein.

Figure 1:
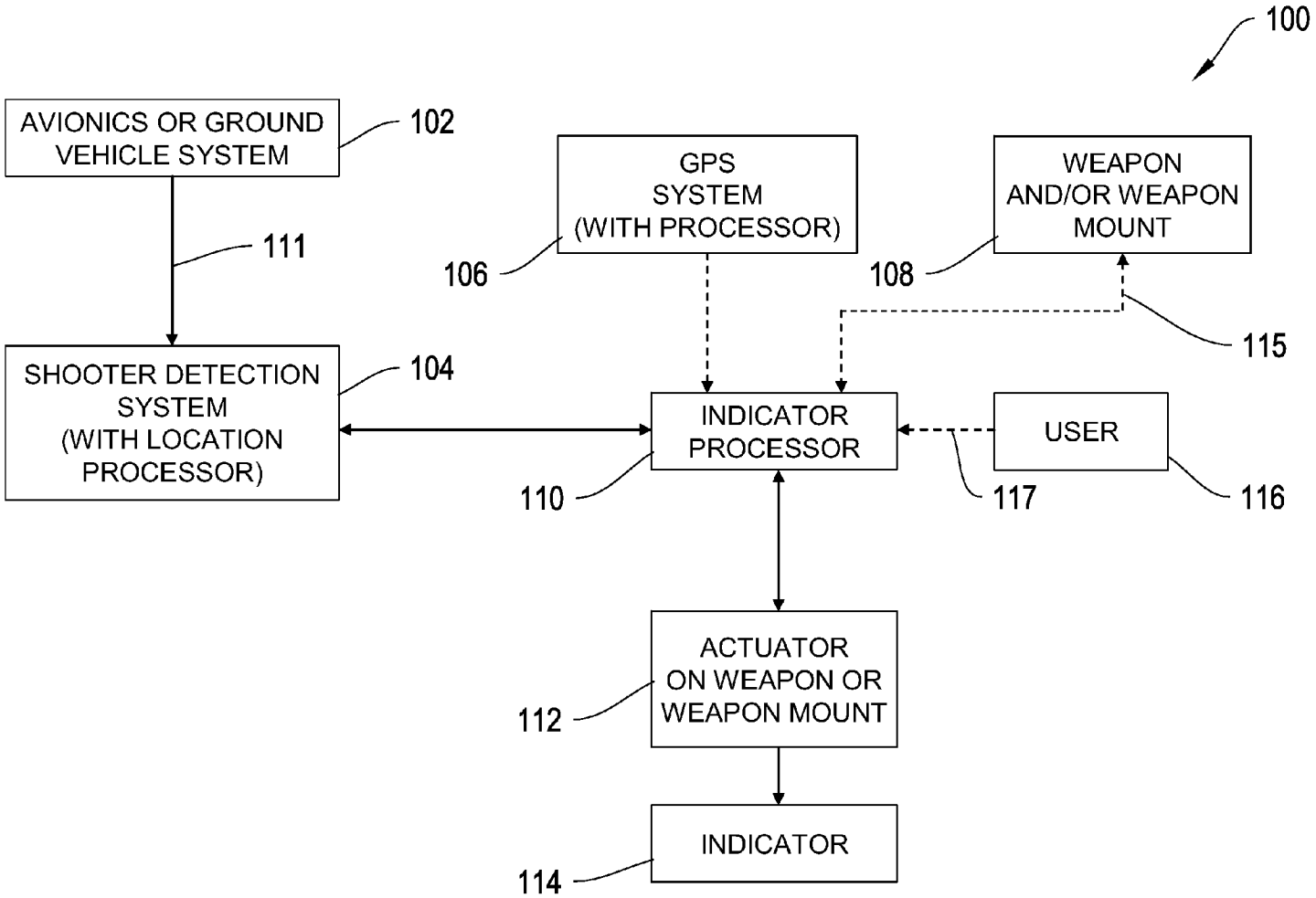
FIG. 1 is a block diagram of a weapon sight indicator system for assisting a gunner in aiming a weapon towards a shooter location, according to an illustrative embodiment of the invention.

FIG. 1 is a block diagram of a weapon sight indicator system 100, according to an illustrative embodiment of the invention. Weapon sight indicator system 100 includes a ground vehicle or avionics system 102, a shooter detection system 104, a weapon (coupled to a weapon mount) 108, an indicator processor 110, an actuator 112, an indicator 114. System 100 may also include a GPS system 106 and a user interface for a user 116. Weapon sight indicator system 100 may be located on any ground vehicle or aircraft, or may even be located on a stand-alone weapon.

More particularly, weapon sight indicator system 100 includes a weapon (and weapon mount) 108, and an indicator 114. The indicator 114 is actuated by an actuator 112 which may be located on the weapon or the weapon mount 108. The actuator 112 is actuated based on control signals provided by indicator processor 110 via any suitable wired or wireless communication link. Actuator 112 may also provide signals indicative of the position of the indicator to the indicator processor 110. Indicator processor 110 communicates with a location processor of shooter detection system 104 to receive the location of one or more shooters that are firing at the ground vehicle or aircraft. Based at least in part on the received shooter location(s), indicator processor 110 determines and provides control signals to the actuator 112 for actuating the indicator 114 to a particular position. In some embodiments, a user input 117 may be received from a user 116 (e.g., a gunner), and the indicator processor 110 determines and provides control signals to the actuator 112 for actuating the indicator 114 based at least in part on the received user input. When the indicator is actuated to the particular position by actuator 112 based on the received control signals received from indicator processor 110, an alignment of weapon 108 to conform to this particular position will result in weapon 108 pointing substantially towards the received shooter location.

In some embodiments, the determination of the particular position for the indicator may be carried out by an application residing on indicator processor 110. This application may include computer-readable instructions which may be executed by the indicator processor 110 to perform any of the methods described herein.

Weapon sight indicator system 100 also includes an avionics or a ground vehicle system 102 which is in communication with shooter detection system 104. As mentioned above, the shooter detection system 104 is in communication with the indicator processor 110. In some embodiments, indicator processor 110 may also be in communication with a global position system (GPS) 106, and may receive information on the location of the aircraft or ground vehicle. In some embodiments, indicator processor 110 may receive inputs from the weapon and/or the weapon mount 108 via communications link 115. The communications between these components may occur over any suitable wired or wireless communications link. In implementations on aircraft such as helicopters, wired communication links may be preferable because of the high levels of electromagnetic interference on the aircraft.

In some embodiments, each of the above described components are located on an aircraft or a ground vehicle. In some embodiments, some of the components such as the shooter detection system 104 or GPS system 106 are located remotely from indicator processor 110, actuator 112, indicator 114, and weapon or weapon mount 108. Illustrative examples include the shooter detection system 104 may be located at a remote ground station and communicate with the indicator processor 110 on an aircraft or in a ground vehicle via a satellite communications link, or the GPS system 106 may be located on a remote aircraft and may transmit geodetic or geographic coordinates to the indicator processor 110 of a portable weapon operated by a gunner on the ground. The shooter detection system 104 and/or GPS system 106 may communicate with indicator processor 110 via any suitable wired or wireless communications link.

In some embodiments, the functions performed by one or more of the location processor of shooter detection system 104, indicator processor 110, the processor of the GPS system 106, and one or more processors of the aircraft/ground vehicle system 102, may be performed by a single one or a subset of these processors. For example, the indicator processor 110 may be part of the aircraft/ground vehicle system 102. Or indicator processor 110 and the location processor of shooter detection system 104 may be a single processor. As another example, indicator processor 110, location processor of shooter detection system 104, and the processor of GPS system 106 may be a single processor. Those skilled in the art will realize that several suitable implementations of the processor architectures are possible, and each of those implementations are intended to be within the scope of this disclosure.

Each of the above described processors of system 100 may be coupled to, among other things, a memory, a user interface (such as a mouse, keyboard, touchscreen, or joystick button), a display (such as a touchscreen display, heads-up display, or helmet display), a network interface (e.g., a modem, a wireless router, a satellite communication link, etc.), and a communications interface (wired or wireless).

Avionics or ground vehicle system 102 is located on an aircraft such as a helicopter, or a ground vehicle such as a humvee, respectively. System 102 includes, inter alia, communication circuitry to communicate with the location processor of the shooter detection system 104 via link 111. System 102 also includes circuitry for communication with a ground station, another ground vehicle, or another aircraft. An avionics system 102 may include sensors such as temperature sensors, aircraft attitude, vector velocity sensors and other sensors such as Mean Sea Level (MSL) and/or Above Ground Level (AGL) altimeters, Global Positioning System (GPS) units, Inertial Navigation System (INS) units, and ground velocity sensors. A ground vehicle system 102 may include Global Positioning System (GPS) units, temperature sensors, and velocity sensors. Each of the sensors that provide outputs to system 102 may be disposed on the external surface of the aircraft or ground vehicle, e.g., on the aircraft fuselage, and/or internally in the aircraft or ground vehicle.

The avionics or ground vehicle system 102 may also be connected to the aircraft or ground vehicle display for displaying, among other things, shooter location information to the pilot or gunner. In certain embodiments, the avionics or ground vehicle system 102 communicates information about shooter location obtained from the location processor of the shooter detection system 104 to the pilot via audio/intercom announcements or visual warnings. The avionics or ground vehicle system 102 may also assist the location processor of the shooter detection system 104 in determining a shooter location by providing relevant data collected from sensors it is connected to and other information obtained from the ground station, another ground vehicle, another aircraft, or a user such as pilot or a gunner.

The location processor of shooter detection system 104 includes various functional applications and/or hardware subcomponents for managing received sensor inputs—directly from the sensors or from the avionics or ground vehicle system 102—and for processing the received sensor data. For instance, location processor of shooter detection system 104 may include a shooter location application for calculating the location of a shooter.

In one embodiment, when a projectile such as a bullet, traveling at supersonic speed, approaches a plurality of sensors of the shooter detection system 104, the projectile generates an acoustic shockwave. The shockwave surface is typically an expanding conical surface having its axis coincident with the bullet trajectory. The shockwave surface is also referred to as the Mach cone. To resolve the location of the shooter, the arrival angle, the radius of curvature, and the spatial gradient of the radius of curvature of the expanding conical surface are determined from arrival times measured at a plurality of acoustic sensors. The plurality of sensors receive the shockwave-only signal at different times and generate electrical signals in response to the shockwave pressure. The shooter location application of the location processor of shooter detection system 104 determines a Time-Difference-Of-Arrival (TDOA) from the initial portion of the shockwave-only signals. The shooter location application then determines the direction (azimuth and elevation angle) of the origin of the bullet from, among other things, the TDOA information. In certain situations, solving for the arrival angle relative to the airframe, of the conical surface that first reaches the sensors may result in two possible solutions (often called ambiguous angles or ambiguous solutions). Determining certain shockwave properties (the arrival angle, the radius of curvature, and the spatial gradient of the radius of curvature of the expanding conical surface) accurately, and deciding between the two possible ambiguous trajectories, requires very precise sensor measurements, as described in U.S. patent application Ser. No. 12/220,745, the contents of which are incorporated herein in their entirety. Several suitable shooter detection systems, each of which provide the location(s) of one or more shooters to a user such as a pilot or gunner using TDOA information are described in the U.S. and PCT publications referenced above, including U.S. Pat. No. 7,126,877, the contents of each of which are incorporated herein in their entirety. The shooter location application of the location processor of shooter detection system 104 may be created and implemented in the location processor using hardware circuitry or using software languages including, but not limited to, C, C++, and JAVA.

Figure 2:
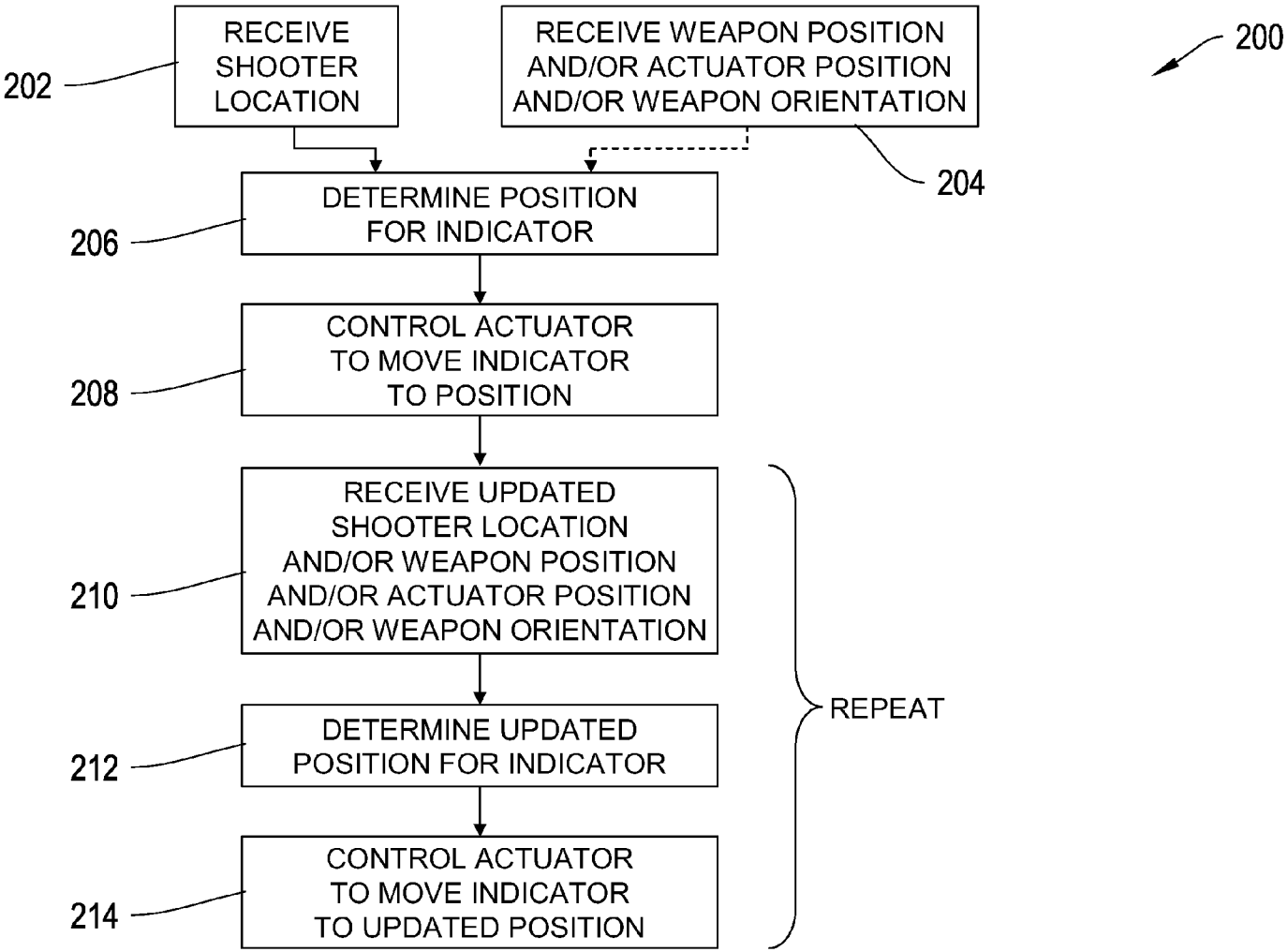
FIG. 2 is a process flow diagram for a process for positioning an indicator to assist a gunner in aiming a weapon towards a shooter location, according to an illustrative embodiment of the invention.

FIG. 2 is a process flow diagram for a process 200 for use in a method for positioning an indicator of a weapon sight indicator system (such as system 100 of FIG. 1) to assist a gunner in aiming a weapon towards a shooter location, according to an illustrative embodiment of the invention. Thus, process 200 may be performed by indicator processor 110 of weapon sight indicator system 100 (FIG. 1). With reference to FIGS. 1 and 2, process 200 begins with indicator processor 110 receiving one or more shooter locations from shooter detection system 104 (202). In some embodiments, indicator processor 110 may also receive additional information such as the position of the weapon 108, the orientation of the weapon 108, and the position of the actuator 112 (204). The weapon position generally refers to the geodetic location of the weapon or the location of the weapon with respect to a moving ground vehicle or aircraft. The orientation of the weapon generally refers to the azimuth and elevation angles of the weapon with respect to a fixed coordination position such as the weapon mount in an aircraft or ground vehicle or a weapon tripod mount. Actuator position generally refers to any information indicative of the position of the actuator 112 and/or the indicator 114. For example, if the actuator were implemented using a servo device including a servo motor, actuator position may refer to the rotational angle of the servo motor.

With continued reference to FIGS. 1 and 2, based at least in part on the received shooter location(s), the indicator processor 110 determines a position for the indicator 114 (206). This position is determined to be one such that if the weapon were aligned to conform (i.e., the weapon axis aligned to be colinear with the indicator position axis) with this position for the indicator, the weapon would point substantially towards the shooter location. Indicator processor 110 then controls actuator 112 to move indicator 114 to the determined position (208). Embodiments of suitable weapons, indicators, and actuators are described below with respect to FIGS. 3A-5C. As shooter locations may change frequently either due to shooter movement or selection of a second shooter for targeting when there are multiple shooters, indicator processor 110 may receive updated shooter location(s) (210).

In some embodiments, indicator processor 110 may also receive additional updated information, such as the updated position of the weapon 108, the updated orientation of the weapon 108, and the updated position of the actuator 112

(210). Based at least in part on the received updated shooter location(s), indicator processor 110 determines an updated position for the indicator 114 (212). This position is again determined to be one such that if the weapon were aligned to conform (i.e., the weapon axis aligned to be co-linear with the indicator position axis) with this position for the indicator, the weapon would point substantially towards the shooter location. Indicator processor 110 then once again controls actuator 112 to move indicator 114 to the determined updated position (214). Steps 210, 212, and 214 may be repeated by indicator processor 110 as many times as desired.

Figure 3A:
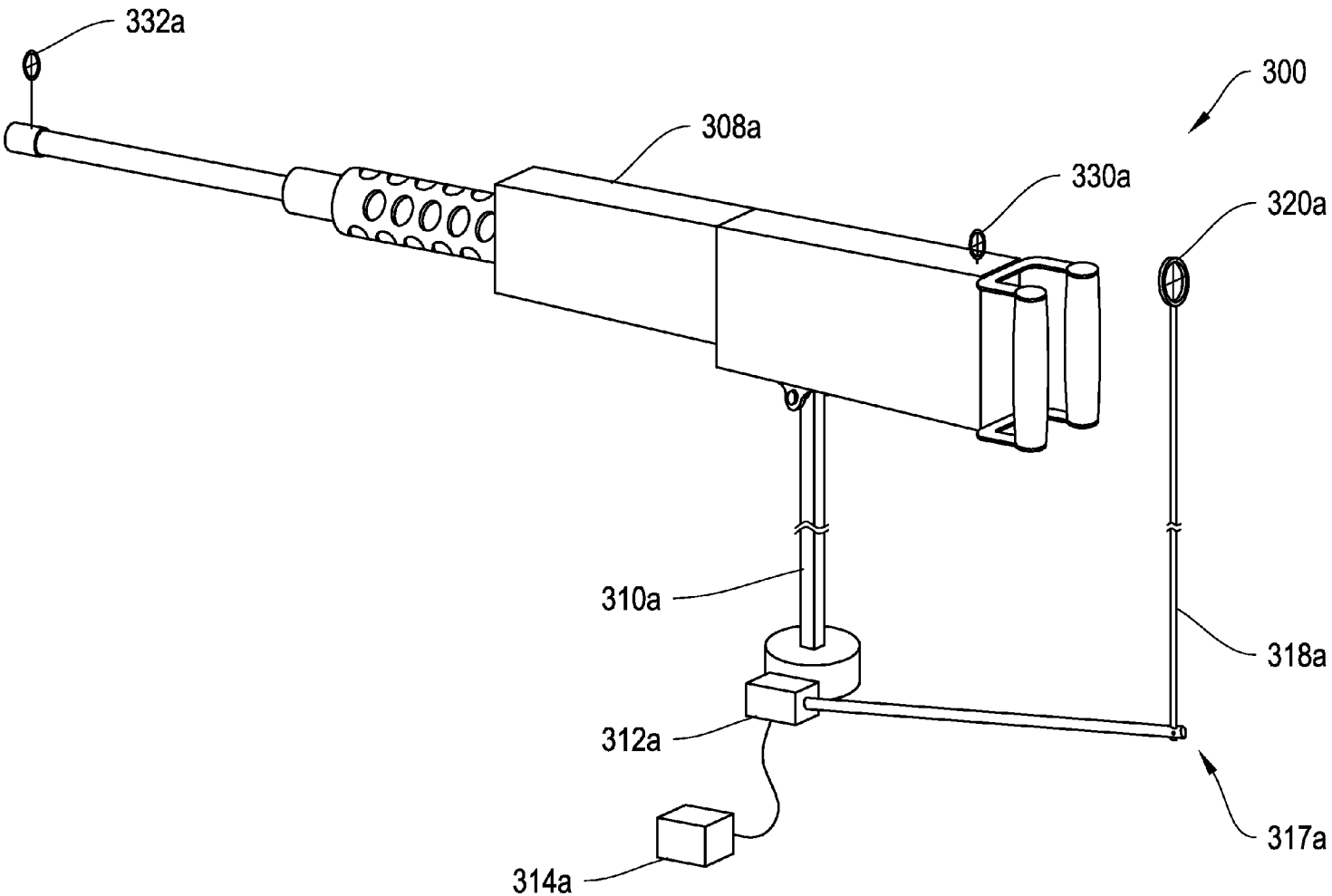
FIG. 3A is a schematic of a weapon sight indicator system coupled to a weapon mount, according to an illustrative embodiment of the invention.

FIG. 3A is a schematic 300 of a weapon sight indicator system located on a weapon mount 310*a* of a weapon 308*a*, according to an illustrative embodiment of the invention. The weapon 308*a* and weapon mount 310*a* may be located on or within a ground vehicle or an aircraft. The weapon 308*a* is operated by a gunner using the weapon's handles and weapon sights—front weapon sight 332*a* and rear weapon sight 330*a*. The weapon sight indicator system has components that were previously described with respect to system 100 (FIG. 1) and process 200 (FIG. 2). Schematic 300 shows the weapon 308*a* mounted on a weapon mount 310*a*. The weapon sight indicator system is also attached to the weapon mount 310*a*, and the attachment will be described further below with respect to FIGS. 5A-C. The weapon sight indicator system comprises an actuator 312*a*, an indicator processor 314*a*, an indicator 317*a*, and is mounted at least in part on the weapon mount 310*a*. The indicator includes a rod 318*a* and a target 320*a*. The actuator 312*a* is coupled to the indicator processor 314*a* via a communication link, as well as coupled to the indicator rod 318*a* via a suitable electromechanical coupling.

The indicator processor 314*a* receives information indicative of a shooter location from a shooter detection system (such as shooter detection system 104 in FIG. 1). The information may be received via a wired or wireless communication link as the shooter detection system may be located on the same aircraft or same ground vehicle as the weapon 308*a*, or may be remotely location on another aircraft, ground vehicle or ground station. Based on the received shooter location information, indicator processor 314*a* provides a control signal to actuator 312*a* to move the indicator 317*a* such that when indicator target 320*a* is aligned with the weapon rear sight 332*a* and/or weapon front sight 330*a*, the weapon 308*a* points substantially towards the received shooter location. In some embodiments, the indicator processor 314*a* and the actuator 312*a* may be in the same physical location, e.g., both located on weapon mount 310*a*.

Figure 3B:
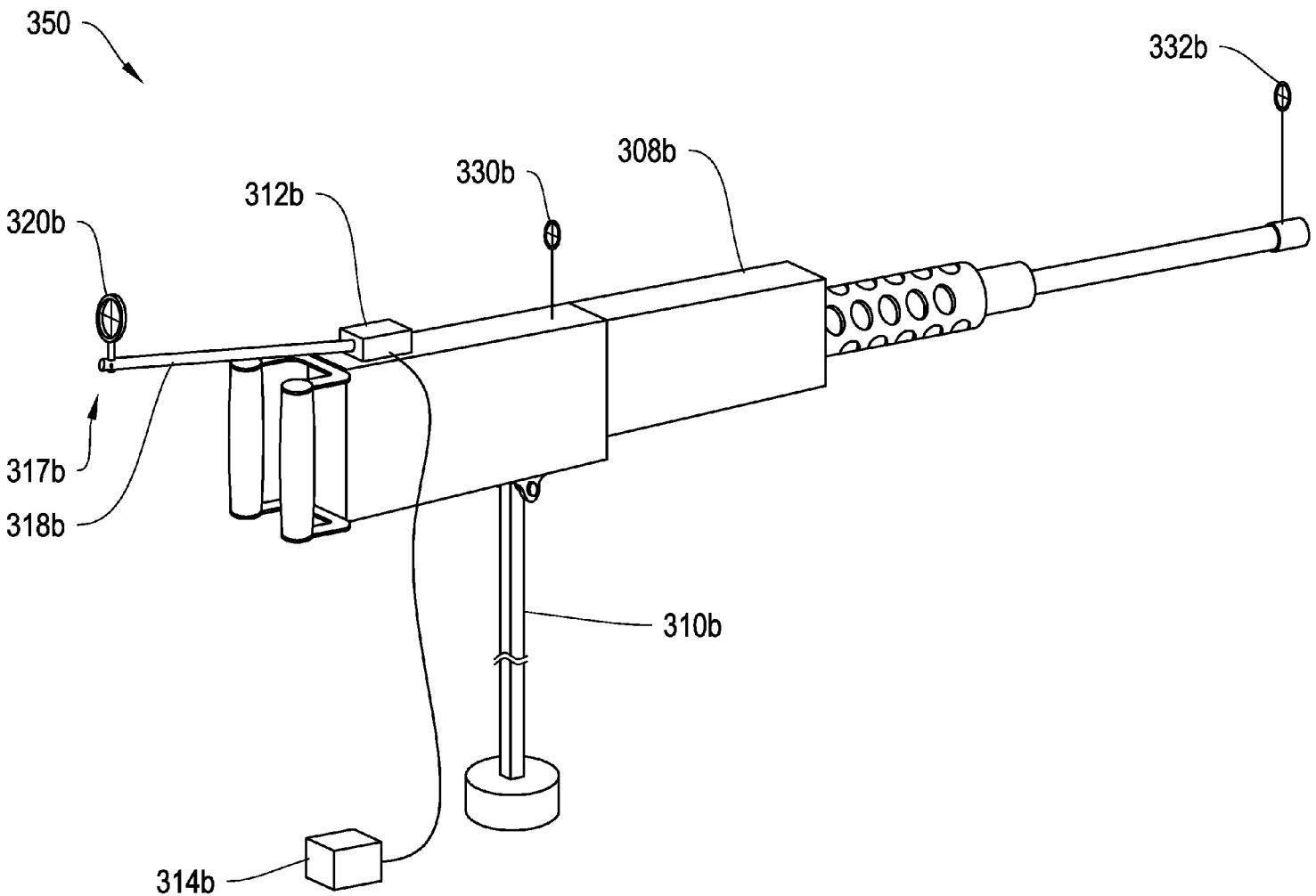
FIG. 3B is a schematic of a weapon sight indicator system coupled to a weapon, according to an illustrative embodiment of the invention.

FIG. 3B is a schematic 350 of a weapon sight indicator system located on a weapon 308*b* which is mounted to a weapon mount 310*b*, according to an illustrative embodiment of the invention. The attachment will be described further below with respect to FIGS. 5A-C. Thus, if the weapon 308*b* were removed from the weapon mount 310*b*, the weapon sight indicator system would remain attached to the weapon 308*b*. The weapon 308*b* may be mounted on a ground vehicle, an aircraft, or may simply be a stand-alone weapon 308*b* mounted on a tripod, for example. The weapon 308*b* is operated by a gunner using the weapon's handles and weapon sights—front weapon sight 332*b* and rear weapon sight 330*b*. The weapon sight indicator system has components that were previously described with respect to system 100 (FIG. 1) and process 200 (FIG. 2). The weapon sight indicator system comprises an actuator 312*b*, an indicator processor 314*b*, an indicator 317*b*. The indicator includes a rod 318*b* and a target 320*b*. The actuator 312*b* is coupled to the indicator processor 314*b* via a communication link, as well as coupled to the indicator rod 318*b* via a suitable electromechanical coupling.

The indicator processor 314*b* receives information indicative of a shooter location from a shooter detection system (such as shooter detection system 104 in FIG. 1). The information may be received via a wired or wireless communication link as the shooter detection system may be located on the same aircraft or same ground vehicle as the weapon 308*b*, or may be remotely location on another aircraft, ground vehicle or ground station. Based on the received shooter location information, indicator processor 314*b* provides a control signal to actuator 312*b* to move the indicator 317*b* such that when the indicator target 320*b* is aligned with the weapon rear sight 332*b* and/or weapon front sight 330*b*, the weapon 308*b* points substantially towards the received shooter location. In some embodiments, the indicator processor 314*b* and the actuator 312*b* may be in the same physical location, e.g., both located on weapon 308*b*. In this case, the indicator position is updated in real-time as the indicator position is based at least in part on the updated weapon position because a gunner may move the weapon frequently.

Figure 4A:
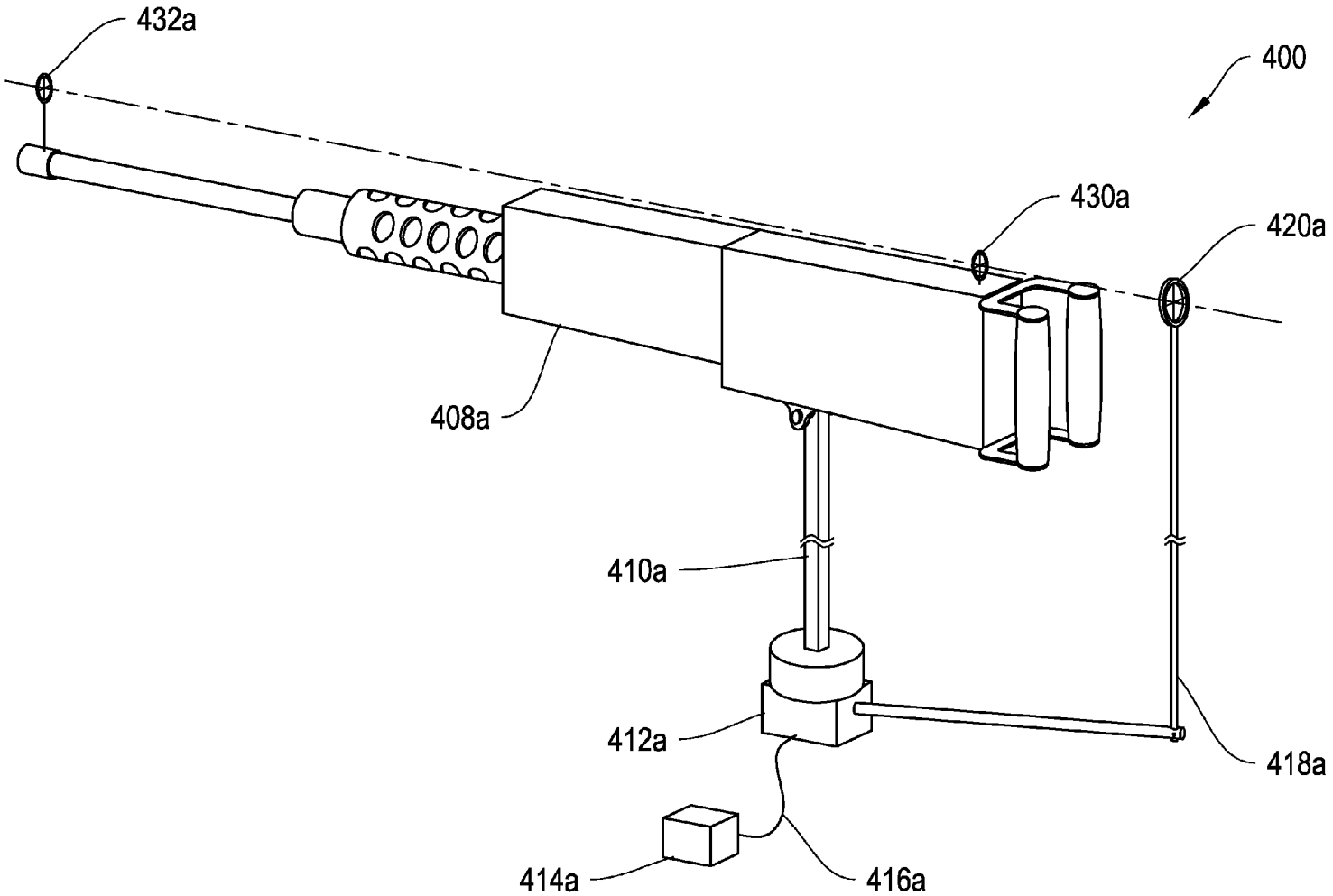
FIGS. 4A and 4B are schematics showing a weapon sight aligned with an indicator and a weapon sight not aligned with an indicator, respectively, according to illustrative embodiments of the invention.
Figure 4B:
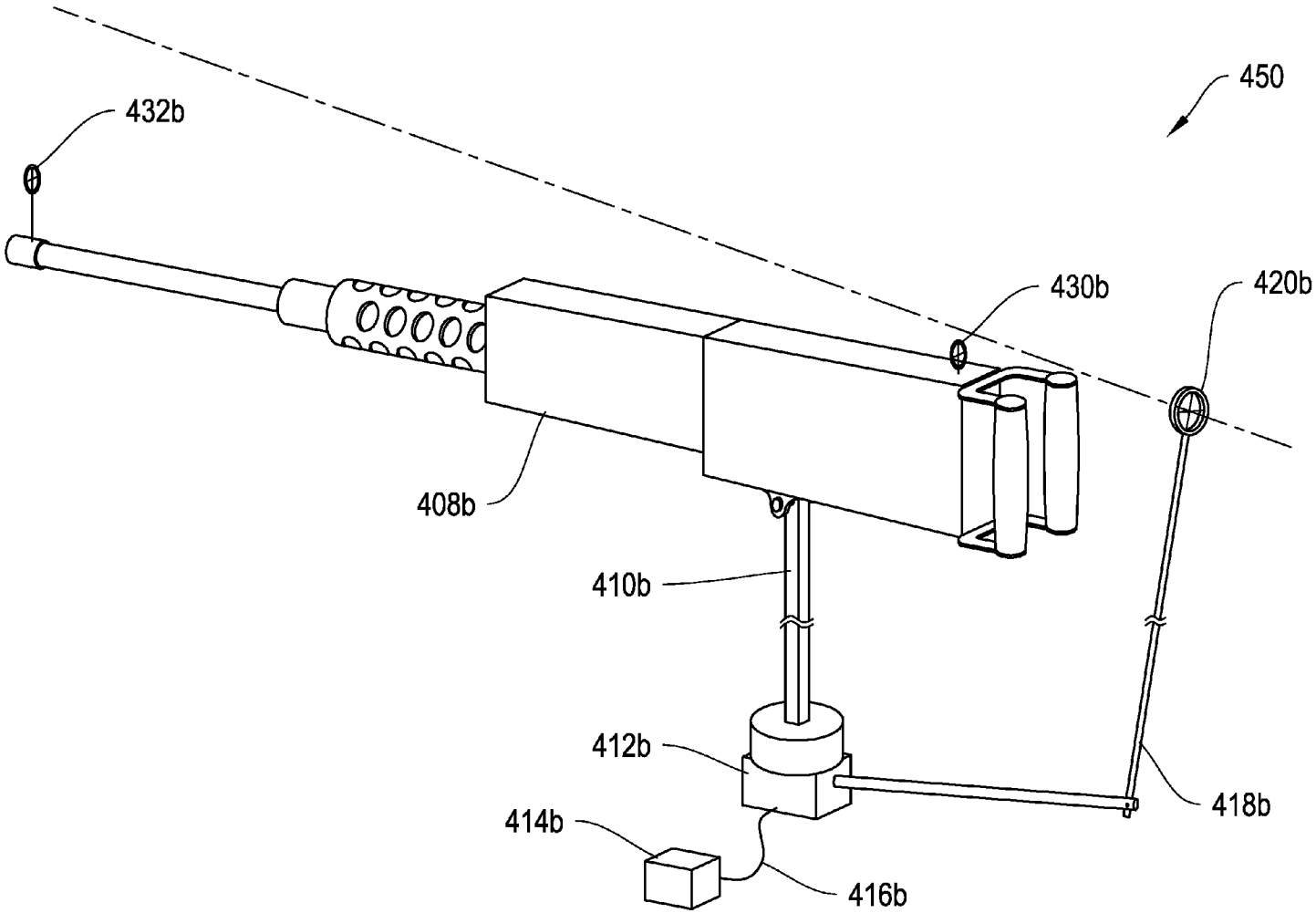

FIGS. 4A and 4B illustrate the alignment of a weapon's sight(s) with an indicator. FIG. 4A is a schematic 400 of a weapon sight aligned with an indicator target, while FIG. 4B shows a schematic 450 of a weapon sight that is not aligned with an indicator target. In the latter case, the weapon would not be pointing towards a shooter location.

In FIGS. 3A and 3C, both front and rear weapon sights are shown. However, in alternative embodiments, the weapon only has a front sight, i.e., the rear sight is optional. For these embodiments, the alignment illustrated in FIGS. 4A and 4B would involve only aligning the front weapon sight with the indicator target.

Figure 5A:
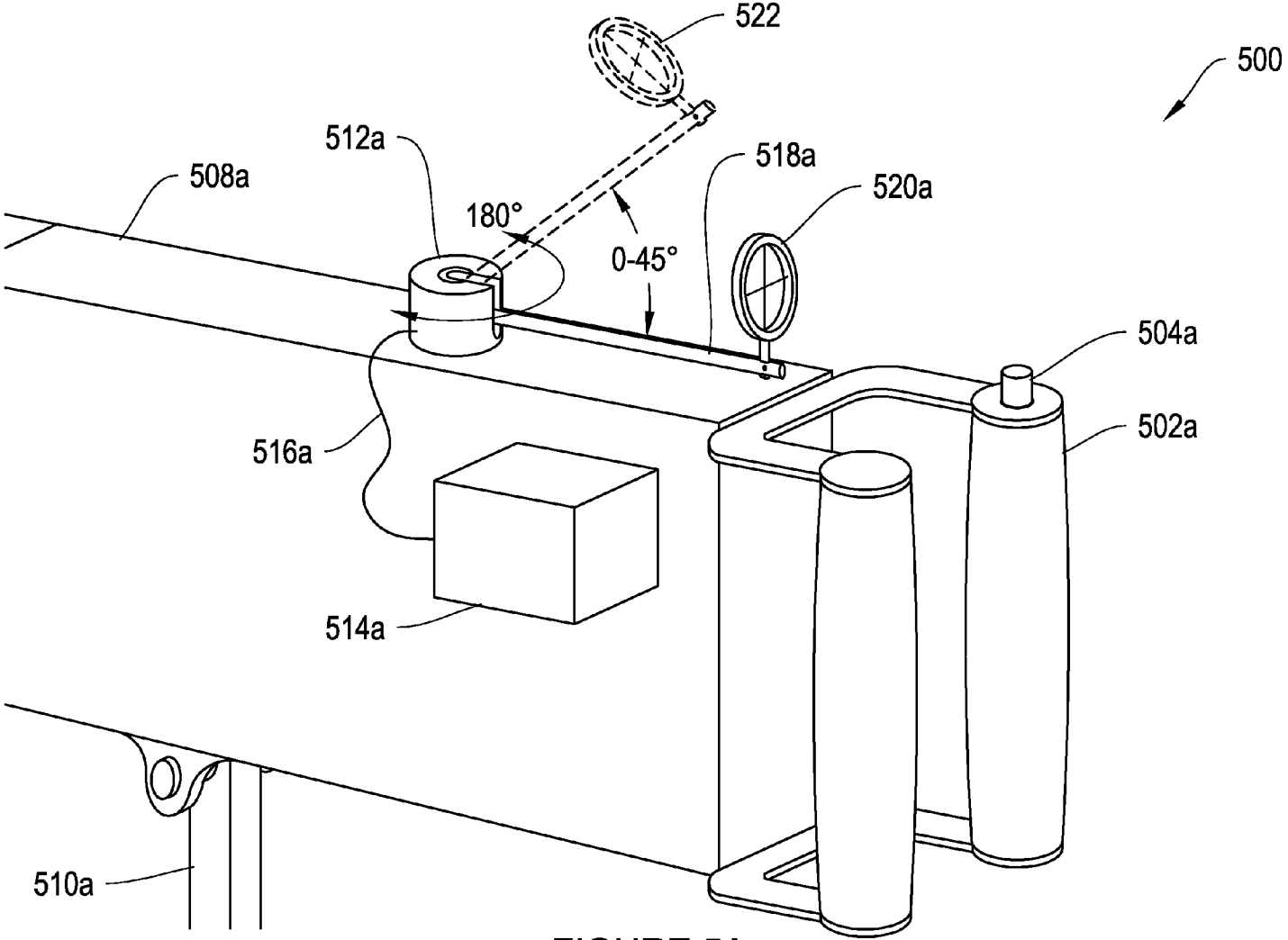
FIG. 5A is a diagram of a weapon sight indicator system showing a servo device and an indicator rod and indicator target attached to a weapon, according to an illustrative embodiment of the invention.
Figure 5B:
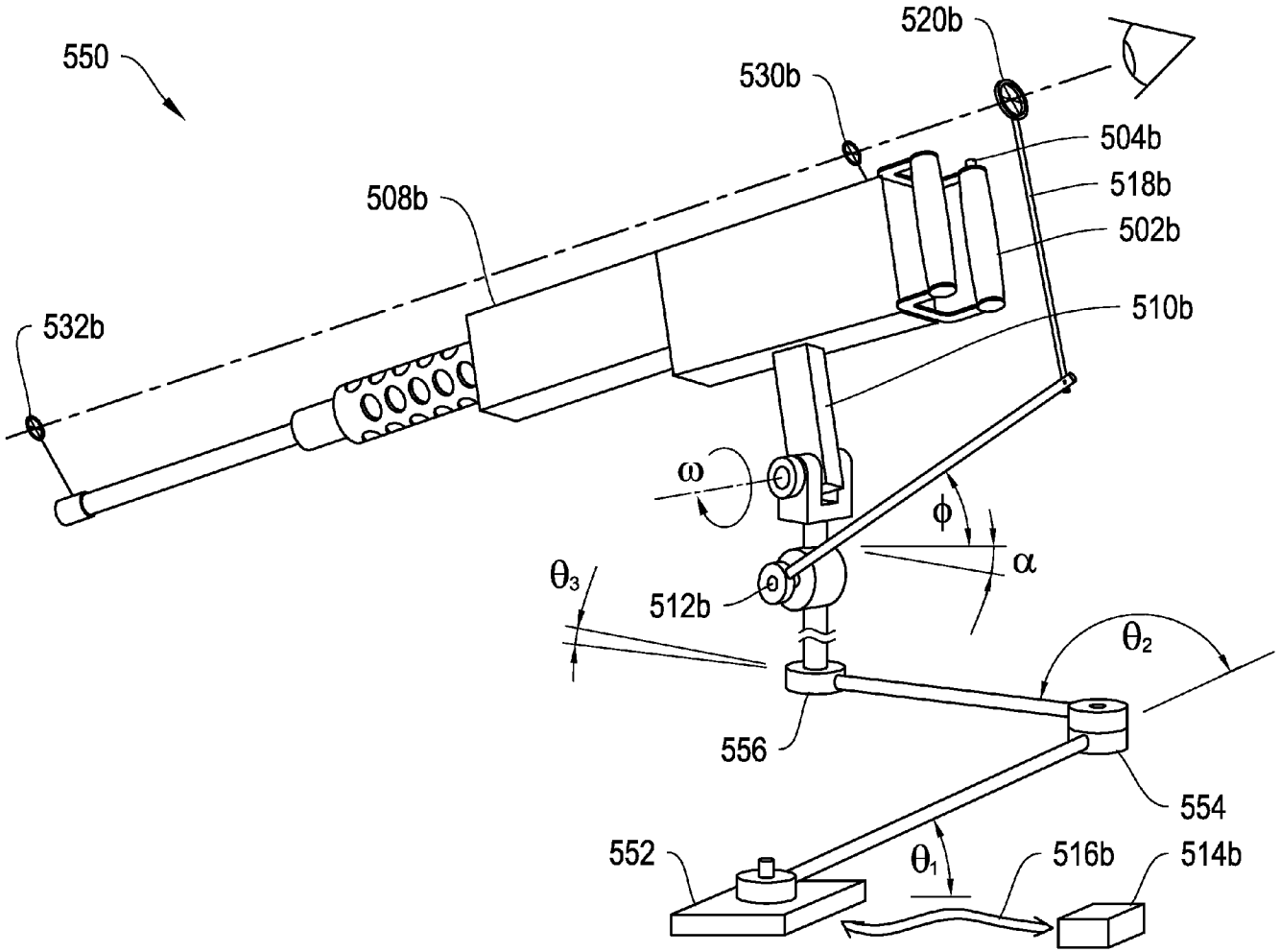
FIG. 5B is a schematic of a weapon sight indicator system attached to a weapon mount, according to an illustrative embodiment of the invention.
Figure 5C:
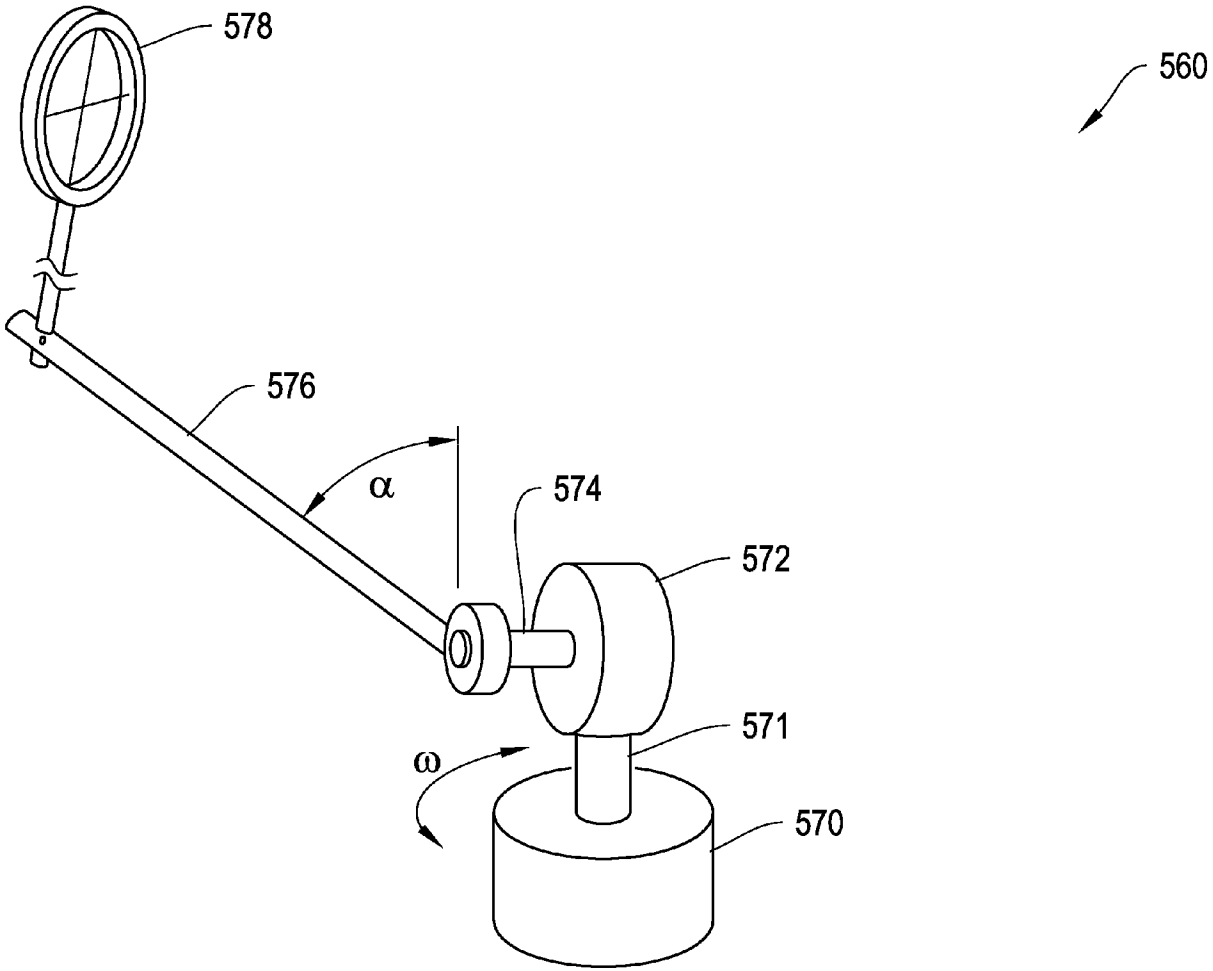
FIG. 5C is a diagram of servo device for a weapon sight indicator system showing a base, horizontal and vertical servo motors, an indicator target and an indicator rod, according to an illustrative embodiment of the invention.

FIGS. 5A-5C show illustrative implementations of weapon sight indicator systems. The general operation of these weapon sight indicator systems were described above with respect to FIGS. 1-4. FIG. 5A shows a weapon-mounted system, FIG. 5B shows a weapon mount-mounted system, and FIG. 5C shows a servo device that may be employed in the illustrative implementations of FIGS. 5A and 5B. In each of these illustrative implementations, while not always specifically shown, it is assumed that signals indicative of one or more of actuator position (e.g., actuator azimuth and elevation angles with respect to the weapon or weapon mount), weapon orientation (e.g., weapon azimuth and elevation angles with respect to a reference location), and indicator position (e.g., indicator azimuth and elevation angles) are measured using suitable position sensors, and transmitted to the indicator processor of the respective weapon sight indicator systems. These transmissions may occur over any suitable wired or wireless transmission link. Suitable position sensors may include, among other things, variable resistors (rheostats) coupled to current sources within the indicator processor such that voltage samples of the rheostat signals coming into the indicator processor will be indicative of the position.

FIG. 5A is a diagram 500 of a weapon sight indicator system showing a servo device 512*a*, an indicator rod 518*a*, and an indicator target 520*a* attached to a weapon 508*a*. The weapon 508*a* is removeably attached to the weapon mount 510*a*. Thus, if the weapon 508*a* is removed from the weapon mount 510*a*, the weapon sight indicator system remains attached to the weapon 508*a*. The servo device 512*a* is coupled to the indicator rod 518*a*, which in turn is rigidly connected to the indicator target 520*a*. The servo device 512*a* may include one or more sensors for measuring positions of components (e.g., motors) within the servo device. The weapon sight indicator system may also include one or more sensors for measuring the orientation of weapon 510*a* (e.g., azimuth and elevation angles of the weapon breach).

The weapon sight indicator system of FIG. 5A includes an indicator processor 514*a*. The servo device 512*a* communicates with the indicator processor via link 516*a*. Link 516*a* may be any suitable wired or wireless communication link. The indicator processor 514*a* sends control signals to the servo device 512*a* for actuating the indicator rod 518*a* (and thus the indicator target 520*a*) to move to a determined position. This position is determined based at least in part on shooter location information received by the indicator processor 514*a* from a shooter detection system and based at least in part on the weapon orientation. As described above, because gunners may move the weapon frequently, the indicator position is updated in real-time, i.e., the indicator position is constantly updated to account for the weapon's movement.

In some embodiments, the servo device 512*a* sends information indicative of the angular positions (azimuth and elevation) of the servo device 512*a* to the indicator processor 514*a* via link 516*a*. The servo device 512*a* may actuate the indicator rod 518*a* between about −10 to about 90 degrees in elevation angle (with respect to the top of weapon 508*a*) and about 0 degrees to about 180 degrees in azimuth angle. For example, in position 522, indicator target 520*a* is about 45 degrees in elevation angle with respect to the top of weapon 508*a*. These angular ranges are merely illustrative. For example, in some embodiments, such as weapons mounted on ground vehicle turrets described below with respect to FIG. 7, the servo device 512*a* may be configured to actuate the indicator rod 518*a* from about 0 to 360 degrees. Indicator processor 514*a* may be located on the weapon 508*a* itself, on the weapon mount 510*a*, or even remotely located from the servo device 512*a*.

The weapon 508*a* is mounted on a weapon mount 510*a*, and includes handles 502 and a user input device 504. A gunner may move the gun using the handles 502 and may activate the user input device 504, e.g., by pressing down on the device. The weapon 508*a* also has a trigger device which may be actuated by the gunner. Inputs from the user input device 504 are received by the indicator processor 514*a*. In some embodiments, the user input is indicative of a command to switch targeting to another shooter if multiple shooters have been detected. In response to the user's selection, the indicator processor 514*a* controls the servo device 512*a* to move the indicator rod 518*a* (and thus indicator target 520*a*) to the selected shooter location.

The general operation of a weapon sight indicator system was described above with respect to FIGS. 1 and 2. In summary, when the user of weapon 508*a* moves the weapon 508*a* to align the weapon's rear and/or front sights with the indicator target 520*a*, the weapon 508*a* points substantially towards a received shooter location.

FIG. 5B is a schematic 550 of a weapon sight indicator system attached to a weapon mount 510*b* of a weapon 508*b*. The weapon 508*b* is removeably attached to the weapon mount 510*b*. Weapon 508*b* includes a rear weapon sight 530*b* and a front weapon sight 532*b*. The weapon mount 510*b* is rigidly connected to a servo device 512*b* and a set of hinges 552, 554 and 556. Each of these hinges allows for rotation in the horizontal plane and/or rotation in the vertical plane. For example, hinge 552 may rotate an angle $\theta_1$ in the horizontal plane, while the hinge 556 may rotate an angle $\theta_3$ in the vertical plane. These angles may be any suitable angle. The servo device 512*a* may include one or more sensors for measuring positions of components (e.g., motors) within the servo device. In addition, each of the hinges 552, 554, 556 may include one or more angular or linear position sensors. In each case, the measured positions may be angular or linear positions. The weapon sight indicator system may also include one or more sensors for measuring the orientation of weapon 510*b* (e.g., azimuth and elevation angles of the weapon breach). In FIG. 5B, the elevation angle (also referred to as the weapon or gun training angle) of the weapon breach is labeled $\omega$.

The servo device 512*b* is coupled to indicator rod 518*b*, which is rigidly connected to indicator target 520*b*. Servo device 512*b* may also include one or more angular position sensors for measuring one of angles $\Phi$ and $\alpha$, or the elevation angle $\omega$. The weapon sight indicator system also includes an indicator processor 514*b*, and the servo device 512*b* communicates with the indicator processor 514*b* via link 516*b*. Link 516*b* may be any suitable wired or wireless communication link. In aircraft, wired communication links may be preferred due to the high levels of electromagnetic interference. The indicator processor 514*b* sends control signals to the servo device 512*b* for actuating the indicator rod 518*b* (and thus the indicator target 520*b*) to move to a determined position. This position is determined based at least in part on shooter location information received by the indicator processor 514*b* from a shooter detection system and based at least in part on angular position information received from sensors associated with the weapon and/or the servo device. For example, the hinge angles $\theta_1$, $\theta_2$, and $\theta_3$ may be summed to determine the weapon's azimuth angle, while the elevation angle of weapon 508*b* may be obtained by summing the angles $\Phi$ and $\alpha$. This information may be used by indicator processor 514*b* to determined indicator position.

In some embodiments, the servo device 512*b* sends information indicative of the angular positions (azimuth and elevation) of the servo device 512*b* to the indicator processor 514*b*. The servo device 512*b* may actuate the indicator rod 518*b* between about −10 degrees to about 90 degrees in elevation angle (with respect to the weapon mount 510*b*) and about 0 degrees to about 180 degrees in azimuth angle with respect to the weapon mount 510*b*. These angular ranges are merely illustrative. In some embodiments, information indicative of the angular positions of the hinges 552, 554, and 556 is sent to indicator processor 514*b*. The position of the indicator rod 518*b* (and indicator target 520*b*) is determined based at least in part on the received angular position information received by the indicator processor 514*b* from a shooter detection system. In particular, the control signals from indicator processor 514*b* to servo device 512*b* will be determined based in part on the received angular position information.

Indicator processor 514*b* may be located on the weapon 508*b* itself, on the weapon mount 510*b*, or even remotely located from the servo device 512*b*. The weapon 508*b* also includes handles 502*b* and a user input device 504*b*, which operate as described above with respect to FIG. 5A.

The general operation of a weapon sight indicator system was described above with respect to FIGS. 1 and 2. In summary, when the user of weapon 508*b* moves the weapon 508*b* to align the weapon's rear 530*b* and/or front 532*b* sights with the indicator target 520*b*, the weapon 508*b* points substantially towards a received shooter location. In some embodiments, the servo device 512*b* includes a self-restoring mechanism. A self-restoring mechanism is beneficial because the indicator rod 518*b* is apt to collide with the user (e.g., a gunner) when the user slews the weapon 5108*b* unexpectedly. Thus, a self-restoring mechanism prevents injury to a gunner and/or damage to the indicator rod 518*b* or indicator target 520*b* as the user moves the weapon 508*b*. In some embodiments, the self-restoring mechanism is a flexible, resilient spring, or made from a suitable flexible, resilient material. The self-resorting mechanism is located near the servo device 512*b*. In some embodiments, the indicator rod itself may be constructed from flexible, resilient material.

In FIGS. 5A and 5B, both front and rear weapon sights are shown. However, as described above, in alternative embodiments the weapon only has a front sight, i.e., the rear sight is optional.

FIG. 5C shows an illustrative implementation of a servo device suitable for use in the weapon sight indication systems described with respect to FIGS. 5A and 5B. This servo device may be mounted on a weapon or weapon mount as shown in any of FIGS. 3A-5B. In particular, FIG. 5C is a diagram 560 of an actuator for a weapon sight indicator system showing a base 570, a horizontal servo motor 570, a vertical servo motor 572, an indicator rod 576, and an indicator target 578, according to an illustrative embodiment of the invention. The horizontal servo motor 570 is coupled to the vertical servo motor 572 via electromechanical coupling 571, while the vertical servo motor 572 is coupled to the indicator rod 576 via electromechanical coupling 574. The horizontal servo motor 570 is configured to rotate indicator rod 576 in the horizontal ($\omega$) direction, while the vertical servo motor 572 is configured to rotate indicator rod 576 in the vertical ($\alpha$) direction. In most implementations of weapon sight indicator systems, indicator rod 576 will not need to move beyond an approximately 180 degree span in the horizontal direction and about +90 degrees to −10 degrees in the vertical direction. Furthermore the required servo motor torque would need to be more than about 0.1 K cm. These requirements allow the use of reasonably sized servo motors that are typically used in robotics applications, e.g., the HS-5045HB AGTT digital micro servo (HITEC Corporation, Littleton, Mass.), which weights 8 g and can generate a 1 K cm maximum torque. Such servos have in-built position sensors and digital controllers, such that they only require a digital input command for the desired angular rotation(s). In the case of the weapon sight indicator system, this digital input command would be provided by the indicator processor, and would be determined based at least in part on a received shooter location from a shooter detection system.

Figure 6:
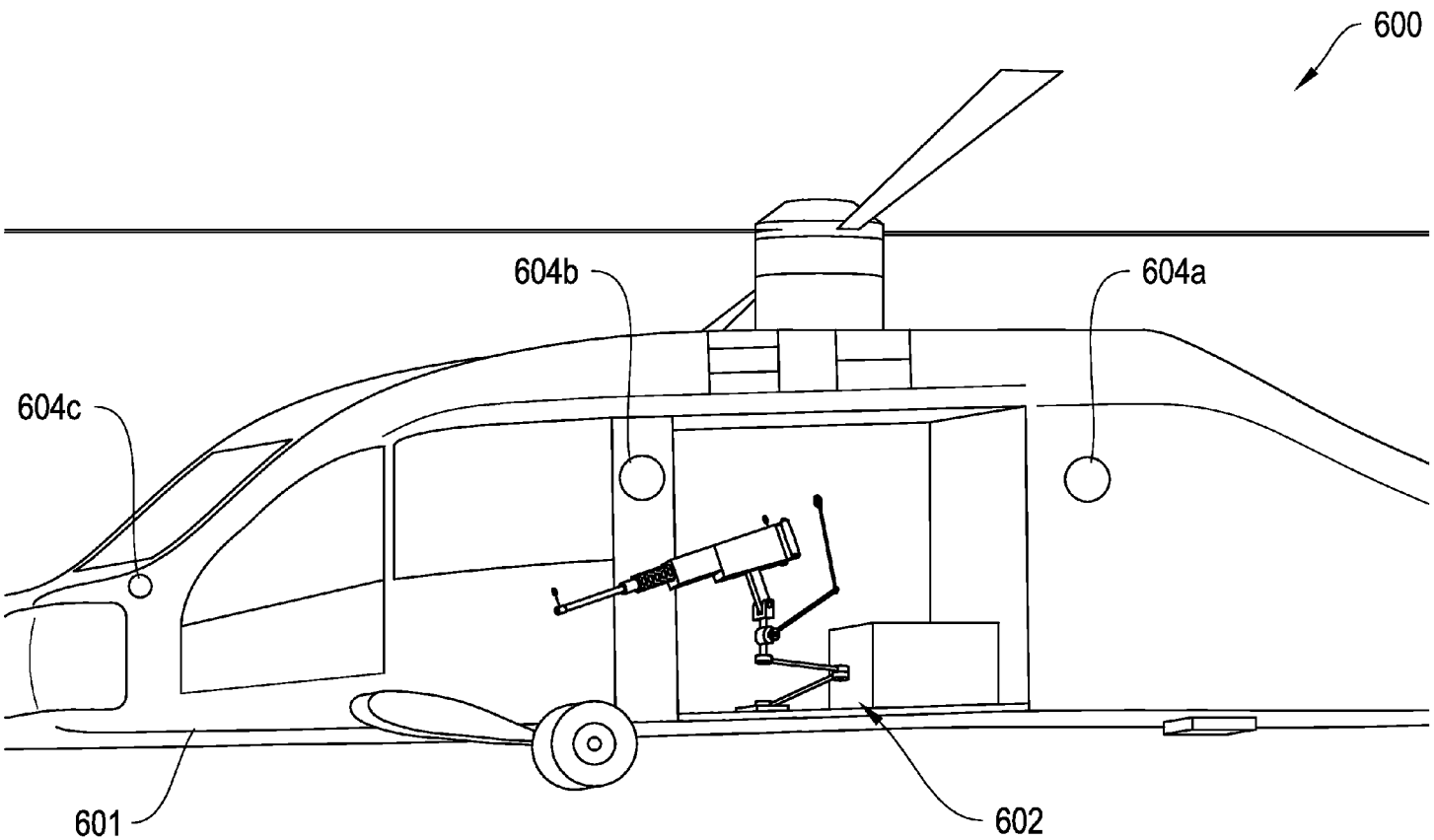
FIG. 6 is a schematic of a helicopter with a weapon and a weapon sight indicator system, according to an illustrative embodiment of the invention.
Figure 7:
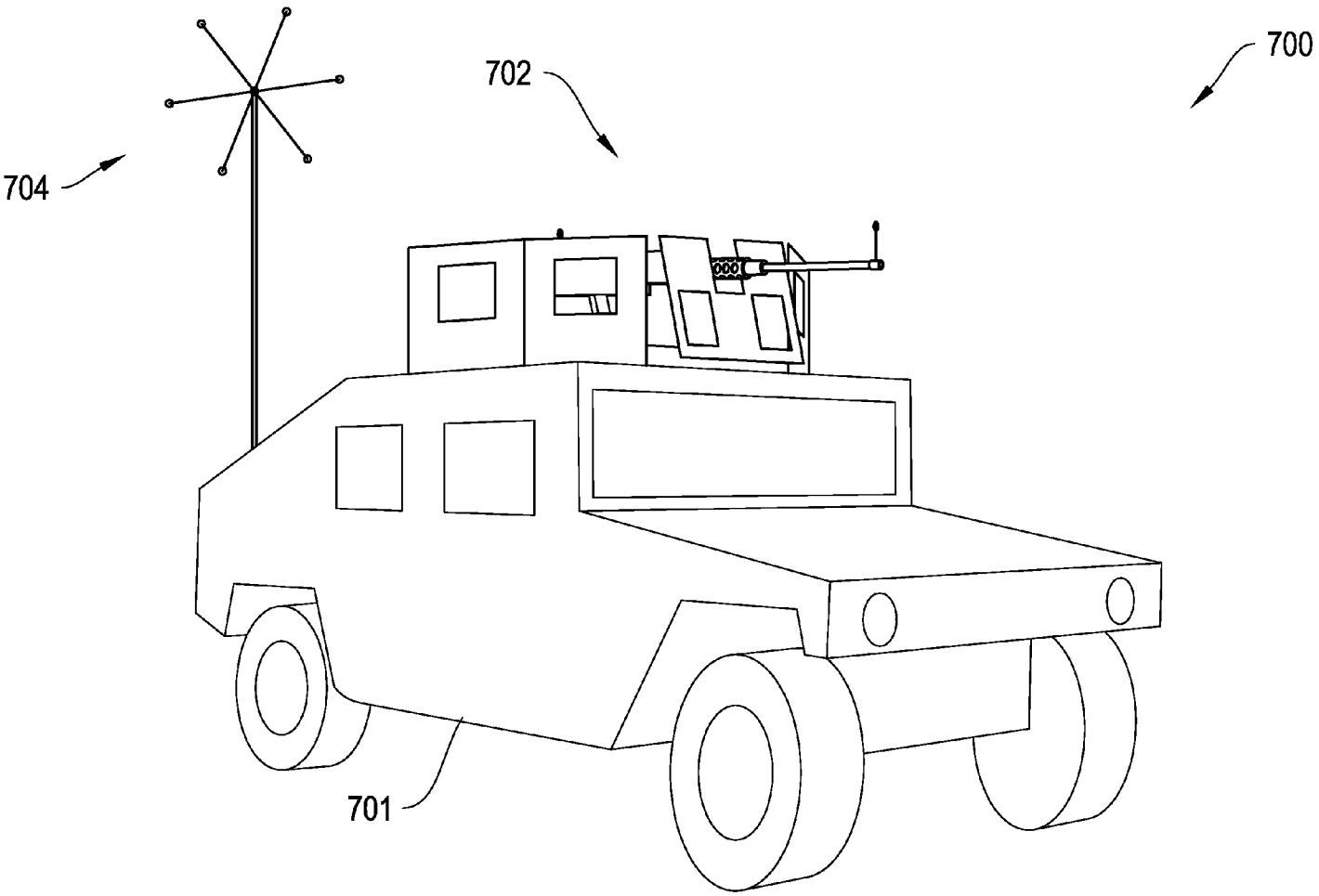
FIG. 7 is a schematic of a humvee with a weapon and a weapon sight indicator system, according to an illustrative embodiment of the invention.
Figure 8:
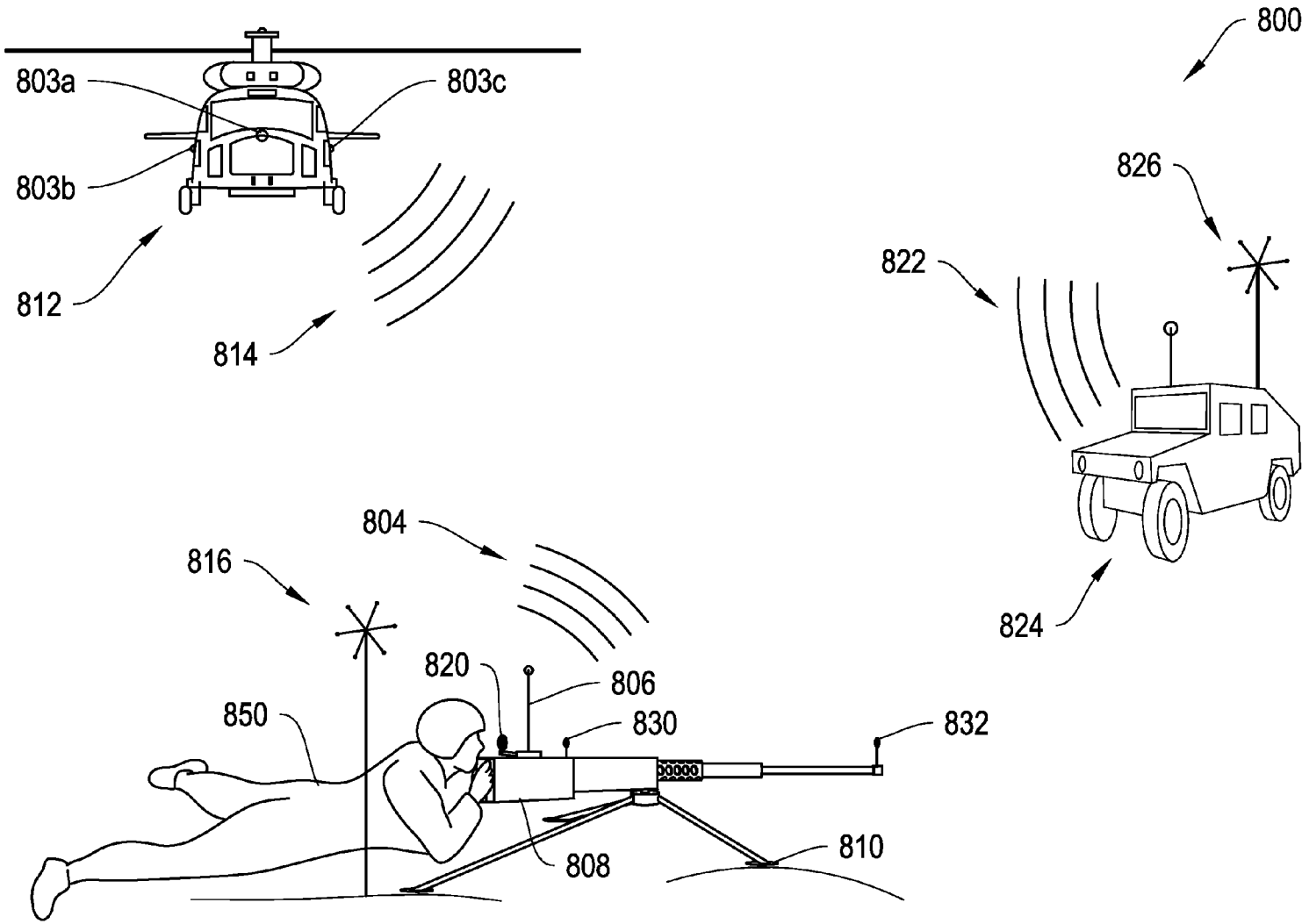
FIG. 8 is a schematic of a portable weapon and a weapon sight indicator system including a processor, wherein the indicator is positioned by the indicator processor communicating with a remote processor, according to an illustrative embodiment of the invention.

FIGS. 6-8 show illustrative applications of the weapon sight indicator systems described with respect to FIG. 1-5C.

FIG. 6 is a schematic 600 of a helicopter 601 with a weapon and a weapon sight indicator system 602 and a plurality of acoustic sensors 604*a*, 604*b*, and 604*c*. The placement and operation of these acoustic sensors is described in U.S. patent application Ser. Nos. 12/220,745 and 12/629,761 and PCT Publication Number WO 2010/030433, the contents of each of which are incorporated herein in their entirety. As described above, in some embodiments, the weapon sight indicator systems described with respect to FIG. 1-5C are positioned within an aircraft such as helicopter 601. The indicator rod (and indicator target) of the weapon sight indicator system 602 are actuated based at least in part on shooter location information received from a shooter detection system located on the helicopter. The shooter detection system receives information from the plurality of acoustic sensors 604*a*, 604*b*, and 604*c*. A gunner in the helicopter 601 could move the weapon using the handles to align at least one of the weapon's front or rear sights with the indicator target. When the indicator target is aligned in this manner, the weapon on the helicopter 601 will be pointing substantially towards the shooter location. As mentioned above, the communication links in a helicopter are generally wired links due to the high levels of electromagnetic interference in the helicopter.

FIG. 7 is a schematic 700 of a humvee 701 with a weapon and a weapon sight indicator system 702 and a plurality of acoustic sensors 701 which are components of a shooter detection system located on the humvee. The placement and operation of these acoustic sensors is described in U.S. Pat. Nos. 7,710,828 and 7,126,877 and PCT Publication Number WO2006/096208, the contents of each of which are incorporated herein in their entirety. As described above, in some embodiments, the weapon sight indicator systems described with respect to FIG. 1-5C are positioned on or within a ground vehicle such as humvee 701. The indicator rod (and indicator target) of the weapon sight indicator system 702 are actuated based at least in part on shooter location information received from a shooter detection system located on the humvee. The shooter detection system receives information from the plurality of acoustic sensors 704. A gunner sitting on a turret in the humvee 701 would move the weapon using the handles to align at least one of the weapon's front or rear sights with the indicator target. When the indicator target is aligned in this manner, the weapon on the humvee 701 will be pointing substantially towards the shooter location.

FIG. 8 is a schematic 800 of a portable weapon 808 mounted on a tripod 810. The portable weapon 808, which is operated by a gunner 850, includes a weapon sight indicator system. The portable weapon also includes front sight 830 and rear sight 832. The weapon sight indicator system may be a system as described above with respect to FIG. 1-5C. In particular, weapon sight indicator system includes an indicator target 820 which may be actuated by an actuator that receives control signals from an indicator processor. In some embodiments, the indicator processor is located remotely from the portable weapon 808. In some embodiments, for example, the indicator processor may be carried by the gunner 850 in the gunner's backpack or clothing. The control signals for actuation are then received from the indicator processor via wireless transmission 804 to antenna 806, which is included in the weapon sight indicator system.

In some embodiments, the indicator processor is located on the portable weapon 808. The indicator processor receives a shooter location from a remote processor and the indicator of the weapon sight indicator system is positioned by the indicator processor communicating with this remote processor. In some embodiments, the indicator processor on the weapon 808 also functions as a shooter location processor and may communicate with a plurality of acoustic sensors 816 located, for example, on the ground near the gunner 850. Based on information received from sensors 816, the indicator processor determines shooter location, and based on the determined shooter location, the indicator processor determines the actuator position for the actuator of the weapon sight indicator system.

The above described remote processors may be located at a ground station, or on a remotely located helicopter 812, or a remotely located humvee 824. For example, remote processors in the helicopter 812 and/or the humvee 824 may transmit wireless transmissions 814 and 822, respectively. The helicopter 812 may include a shooter detection system in communication with a plurality of acoustic sensors 803*a*, 803*b*, and 803*c*. The humvee 824 may include a shooter detection system with a plurality of acoustic sensors 826. The implementation of FIG. 8 may be used in a coordinated attack system in which several gunners, aircraft, or ground vehicles are provided with target locations.

In addition to receiving signals from a remote processor via antenna 806, the indicator processor of the weapon sight indicator system on the weapon 808 may transmit signals indicative of the position of the actuator and/or of the weapon orientation may be transmitted from the weapon sight indicator system to the remote processor. For example, weapon orientation may be transmitted as a pair of (azimuth, elevation) angle pairs for the weapon 808. These angles could be measured with respect to the weapon barrel's zero elevation and heading either with a manual input to the indicator processor or the remote processor, or with weapon-mounted angular position sensors.

In some embodiments, the indicator processor may be coupled to a GPS system via a wireless or wired transmission link, or may have an in-built GPS system. A GPS system would allow the indicator processor of the weapon sight indicator system to receive and use the weapon's 808 position in geodetic coordinates. In some embodiments, GPS location is provided by a remote processor and the indicator processor merely receives this information without being coupled to a GPS system.

The invention may be embodied in other specific forms without departing from the spirit or essential characteristics thereof. The forgoing embodiments are therefore to be considered in all respects illustrative, rather than limiting of the invention. Thus, variations, modifications, and other implementations of what is described may be employed without departing from the spirit and scope of the invention. For example, the systems and methods described herein may be employed in any application in which military personnel such as gunners need to be informed of the geographic or geodetic location of an enemy target. Thus, the target does not always have to be a known shooter and the weapon sight indicator system may receive any geographic or geodetic location, without limitation. More specifically, any of the method and system features described above or incorporated by reference may be combined with any other suitable method or system feature disclosed herein or incorporated by reference, and is within the scope of the contemplated inventions. The systems and methods may be embodied in other specific forms without departing from the spirit or essential characteristics thereof. The foregoing embodiments are therefore to be considered in all respects illustrative, rather than limiting of the invention. The teachings of all references cited herein are hereby incorporated by reference in their entirety.

What is claimed is:

1. A system for providing an indication of a shooter location determined by a shooter detection system to a user of a weapon having a weapon sight, the system comprising:

a moveable electromechanical indicator configured to be moved to a position such that when the weapon sight is aligned with the electromechanical indicator, the weapon points substantially towards the shooter location;

an actuator for controlling the position of the indicator; and a processor configured to:

receive the shooter location from the shooter detection system;

determine the position for the indicator based on the received shooter location; and control the actuator to move the indicator to the determined position.

2. The system of claim 1, wherein the weapon is removeably attached to a weapon mount.

3. The system of claim 1, wherein the processor is further configured to:

receive a signal indicative of the weapon's position; and in response to the received signal, determine an updated position for the indicator.

4. The system of claim 1, wherein the processor is further configured to:

receive an updated shooter location from the shooter detection system; and in response to the updated shooter location, determine an updated position for the indicator.

5. The system of claim 1, wherein the weapon is mounted on one of an aircraft or a ground vehicle.

6. The system of claim 1, wherein the processor is configured to:

receive a second shooter location from the shooter detection system;

determine a second position for the indicator based on the received second shooter location; and control the actuator to move the indicator to the determined second position.

7. The system of claim 6, wherein the processor is further configured to:

provide an aural signal indicative of the second shooter location.

8. The system of claim 6, further comprising:

a user input device configured to receive a user input, and wherein controlling the actuator to move the indicator to the determined second position is based at least in part on the received user input.

9. The system of claim 1, further comprising:

a communications device in communication with the processor configured to:

receive a signal from a remote processor carried on board a vehicle located remotely from the processor.

10. The system of claim 9, wherein the signal is indicative of the shooter location.

11. The system of claim 1, wherein the weapon is removeably attached to a weapon mount.

12. The system of claim 1, further comprising:

a global positioning system (GPS) location system.

13. The system of claim 12, wherein the GPS location system communicates with the processor, and is configured to:

provide a signal indicative of one of the absolute position of the weapon, the location of the weapon relative to the shooter location, and the location of the weapon relative to one of an aircraft and ground vehicle.

14. The system of claim 1, wherein the electromechanical indicator comprises a servo device.

15. The system of claim 14, wherein the servo device includes:

a first servo motor for horizontal actuation of the indicator, and a second servo motor for vertical actuation of the indicator.

16. The system of claim 15, wherein the servo device is mounted on one of the weapon mount and the weapon.

17. The system of claim 16, wherein the processor is configured to:

receive one or more motor position signals from the servo device; and determine a servo device control signal based at least in part on the received shooter location and the received motor position signals; and communicate the servo device control signal to the servo device, the control signal providing instructions for actuating the first and second motors to move the indicator.

18. The system of claim 1, wherein the electromechanical indicator includes an indicator rod.

19. The system of claim 18, wherein the indicator rod is coupled to a self-restoring joint to prevent damage to the pointer during weapon movement.

20. The system of claim 18, wherein the indicator rod is flexible.

21. A method for providing an indication of a shooter location determined by a shooter detection system to a user of a weapon having a weapon sight, comprising:

receiving the shooter location from the shooter detection system;

determining a position for a moveable electromechanical indicator based on the received shooter location, the position such that when a weapon sight for a weapon is aligned with the electromechanical indicator, the weapon points substantially towards the shooter location; and controlling an actuator coupled to the indicator to move the indicator to the determined position, wherein the actuator is controlled by a processor.

22. The method of claim 21, further comprising:

receiving a signal indicative of the weapon's position; and in response to the received signal, determining an updated position for the indicator.

23. The method of claim 21, further comprising:

receiving an updated shooter location from the shooter detection system; and in response to the received signal, determining an updated position for the indicator.

24. The method of claim 21, further comprising:

receiving a second shooter location from the shooter detection system;

determining a second position for the indicator based on the received second shooter location; and controlling the actuator to move the indicator to the determined second position.

25. The method of claim 24, further comprising:

providing an aural signal indicative of the second shooter location.

26. The method of claim 24, further comprising:

receiving a user input from a user input device; and controlling the actuator to move the indicator to the determined second position in response to the received user input.

27. The method of claim 21, further comprising:

receiving a signal from a remote processor.

28. The method of claim 27, wherein the signal is indicative of the location of one of an aircraft, a ground vehicle, and the shooter location.

29. The method of claim 21, further comprising:

receiving a signal from a global positioning system (GPS) location system, the signal indicative of one of the absolute position of the weapon, the location of the weapon relative to the shooter location, and the location of the weapon relative to one of an aircraft and ground vehicle.

30. The method of claim 21, further comprising:

receiving one or more motor position signals from a servo device; the servo device including a first servo motor for horizontal actuation of the indicator and a second servo motor for vertical actuation of the indicator; and determining a servo device control signal based at least in part on the received shooter location and the received motor position signals; and communicating the servo device control signal to the servo device, the control signal providing instructions for actuating the first and second motors to move the indicator.

* * * * *